US006676453B1

(12) United States Patent
Rosset Rubio

(10) Patent No.: US 6,676,453 B1
(45) Date of Patent: Jan. 13, 2004

(54) LOCKING ELEMENT FOR ELECTRICAL CONNECTOR ASSEMBLY

(75) Inventor: José Maria Rosset Rubio, Valls (ES)

(73) Assignee: Lear Automotive (EEDS) Spain, S.L., Tarragona (ES)

( * ) Notice: Subject to any disclaimer, the term of this patent is extended or adjusted under 35 U.S.C. 154(b) by 0 days.

(21) Appl. No.: 10/129,728

(22) PCT Filed: Nov. 10, 2000

(86) PCT No.: PCT/ES00/00429

§ 371 (c)(1),
(2), (4) Date: Aug. 13, 2002

(87) PCT Pub. No.: WO01/35497

PCT Pub. Date: May 17, 2001

(30) Foreign Application Priority Data

Nov. 10, 1999 (ES) ..... 9902830 U

(51) Int. Cl.[7] ..... H01R 13/514
(52) U.S. Cl. ..... 439/752
(58) Field of Search ..... 439/752, 595, 439/701, 687, 696, 731, 397

(56) References Cited

U.S. PATENT DOCUMENTS

| | | | | |
|---|---|---|---|---|
| 4,804,341 A | | 2/1989 | Kato et al. | |
| 5,569,054 A | * | 10/1996 | Yagi et al. | 439/752 |
| 5,595,509 A | | 1/1997 | Fry et al. | |
| 5,755,600 A | * | 5/1998 | Yoshida | 439/752 |
| 6,083,058 A | * | 7/2000 | Fujiwara | 439/752 |
| 6,358,102 B1 | * | 3/2002 | Fukamachi | 439/752 |
| 6,450,840 B2 | * | 9/2002 | Nakamura | 439/752 |

FOREIGN PATENT DOCUMENTS

| | | |
|---|---|---|
| EP | 540008 | 5/1993 |
| EP | 599165 | 6/1994 |
| EP | 903814 | 3/1999 |
| JP | 1294382 | 11/1989 |

* cited by examiner

*Primary Examiner*—Renee Luebke
*Assistant Examiner*—Felix O. Figueroa
(74) *Attorney, Agent, or Firm*—Sughrue Mion, PLLC

(57) ABSTRACT

The electric connecter assembly has a body that is intended to house electric terminals associated with corresponding cables and an element for locking the terminals. The locking body is coupled to the connector by sliding and forms part of one of the walls of the connector.

1 Claim, 2 Drawing Sheets

LOCKING ELEMENT FOR ELECTRICAL CONNECTOR ASSEMBLY

CROSS REFERENCE TO RELATED APPLICATION

This Application is a 371 of PCT/ES00/00429, filed Nov. 10, 2000. The disclosure of which is incorporated herein by reference.

FIELD OF THE INVENTION

The present invention, as indicated by the heading, is for a "LOCKING ELEMENT FOR ELECTRICAL CONNECTOR UNIT", the new characteristics of which as regards construction, conformation, and design comply with the objective for which it has been specifically planned with maximum safety and efficiency.

BACKGROUND

The purpose of the electrical connectors that currently exist on the market is that of centralising cables in, for example, vehicles. The electrical connectors essentially have a housing manufactured using an appropriate non-conductive material inside of which are contained the electrical terminals associated with the corresponding cables. To achieve this, the interiors of the housings are divided up into a number of chambers through which the corresponding cables pass. In addition, they incorporate the means of assembly and immobilisation between connectors, as well as other familiar means by which to insert the unit into the corresponding junction boxes as and when necessary.

From a construction point of view, the connectors must include a configuration that allows for the female terminals to be coupled with the corresponding male terminals in a rapid and efficient manner, and at the same time allow for the use of a large number of identical connectors for the linking of the male and female terminals. Another of the characteristics that electrical connectors must include is that of guaranteeing the order in which the terminals are laid out inside the connector, as well as the means to avoid the separation of the terminals due to undesirable influences upon the electric cables.

As regards the technical aspects to which the object of the present invention refers, the connectors in question are those of the type that include a number of locking elements that attempt to secure the internal position of the terminals. These terminal locking elements or anchoring system allow for the position of the terminals inside the connector to be maintained.

Conventional housings contain a terminal locking element to secure the position of the terminal in respect to the housing. The locking element is inserted into the housing once the terminals have been correctly fitted within the interior of the housing. Generally speaking, the conventional structure of the locking element consists of what is fundamentally a rectangular plate that includes a number of circular openings to allow for the passage of the cables. Two parallel plates emerge perpendicularly from this first plate, both of which are fitted with a plurality of ridges running parallel with each other thus defining a number of grooves that correspond to the aforementioned openings and serve as guides for the cabling.

There exist connectors in which both the male and female terminals are introduced via the upper or lower part of the connector. There also exist connectors into which the terminals are inserted laterally, as described in Spanish utility model Num. 9503317 of the same applicant. In this case, the cable is inserted into a connector of an appreciably prismatic configuration, but lacking one of its main seatings, thus making it possible to connect the male terminal and the female terminal by positioning one of them within the specially provided cavity within the interior of the connector. The terminal locking elements are attached to one of the interior dividing partitions of the connector that form the aforementioned chambers.

In the U.S. Pat. No. 5,595,509, an electrical connector assembly is described which includes an elongated housing having a plurality of terminal-receiving cavities extending transversely of the housing. For the maintenance of the terminals inside the connector exists an elongated bifurcated terminal position assurance device which includes a pair of longitudinal legs insertable into two channels unless one of the channels is blocked by a portion of one of the terminals in either row thereof.

Other documents which disclose locking elements of the type described above are EP-A-054008, EP-A-0599165 and U.S. Pat. No. 4,804,341.

SUMMARY OF THE INVENTION

The principal objective of the invention herewith presented is to provide a locking element for an electrical connector unit, especially for an electrical connector unit to be used in the technical sector of automobile manufacture, and one that could be used in different types of connectors without the need to modify the internal geometry of the connector.

Generally speaking, the electrical connector units for which the locking element presented here has been invented are of the type described above. This is to say that they consist of a housing adapted to accommodate a number of electrical terminals associated with their corresponding cables and a locking element to hold the terminals in place. The distinguishing feature of the locking element lies in the fact that it is slide-mounted in the connector casing thereby forming part of one of the lateral walls thereof. Furthermore, the locking element includes a longitudinal flange that protrudes into the interior of the connector in order to retain the terminals in place in such a way that the locking element fixes the terminals transversally with respect to their position within the connector.

In order to slide-mount the locking element in the connector casing, the locking element has a dovetail shape adapted to fit into a track incorporated into at least one of the lateral walls of the connector.

BRIEF DESCRIPTION OF THE DRAWINGS

The characteristics and the advantages of the electrical connector unit in accordance with the present invention will be made all the more clear in the detailed description of an ideal layout of the unit. The description will be given, from here onwards, as a non-restrictive example, with reference being made to the accompanying drawings, in which.

Finally.

DESCRIPTION OF THE INVENTION

Figure 1:
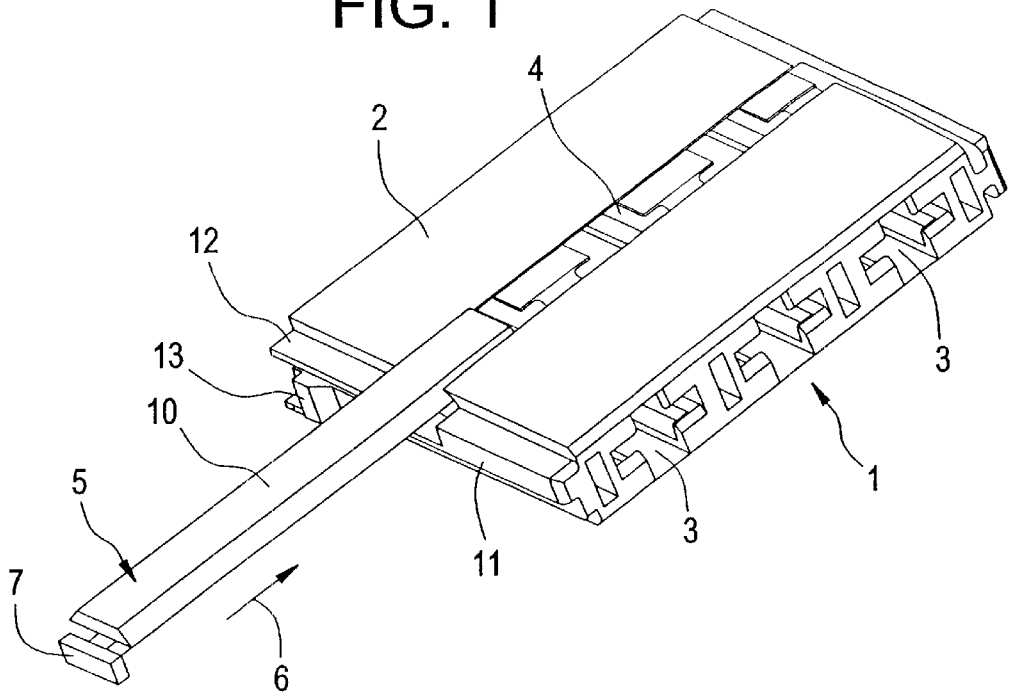
FIG. 1 is a view in perspective of an electrical connector used in the automobile manufacturing sector that includes a locking element, which is shown partially introduced into the electrical connector.

The different elements that appear in the figures are: (1) electrical connector, (2) connector casing, (3) interior chambers, (4) connector casing track, (5) locking element, (6) the direction in which the locking element is introduced into the connector casing, (7) fulcrum at the free end of the locking element, (8) interior flanges of the connector, (9) longitudinal flange of the locking element, (10) exterior face of the locking element, (11) lateral walls of the connector, (12) vanes, and (13) the elastic attachment of the connector.

As can be appreciated in the figures, the electrical connector, which as a whole has been designated the reference number (1), consists of a casing (2) of a fundamentally prismatic configuration. The casing (2) incorporates a number of interior chambers (3) the configuration of which is also prismatic, and these are separated by partitions to allow for the introduction of the corresponding terminals lined up on the end of an electrical conductor (not shown). On one of the faces of the casing (2) of the connector (1) there is a track (4) that runs transversely in respect to the general layout of the interior chambers (3). The track (4) is so designed as to allow a locking element (5) to be slid into place. This can be adequately inserted into the connector (1) by pushing it in the direction indicated of the arrow (6) in FIG. 1 applying a light pressure on the fulcrum (7) at its free end.

Figure 2:
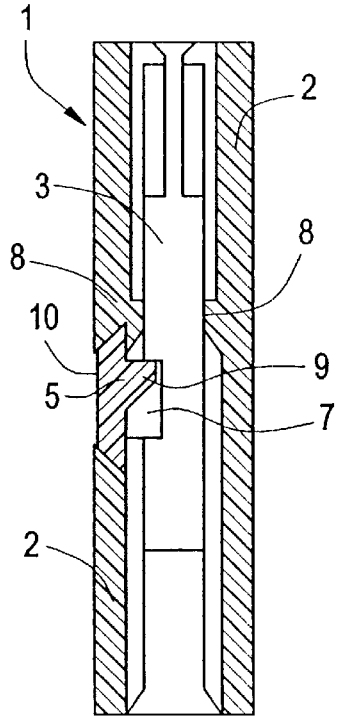
FIG. 2 is a view in transverse section of the connector unit with the locking element fully inserted therein.

With particular reference to FIG. 2, the interior configuration of the chambers (3) is such as to define a number of flanges (8) that extend inwards into the chambers with the aim of exerting the primary retention upon the terminals (not illustrated in the figure). The locking element (5), as has been previously described, works in conjunction with the aforementioned interior flanges (8). In order to achieve this, the locking element (5), as illustrated in FIG. 2, has a dovetail cross section, the geometry of which complements the geometry of the track (4) in the casing (2) of the connector (1).

The locking element (5) includes a longitudinal flange (9) that extends towards the interior of the chamber (3). The depth of the longitudinal flange (9) is essentially greater than that of the interior flanges (8) of the chamber (3). For this reason, once the locking element (5) has been inserted into the track (4), the longitudinal flange (9) provides a secondary retention of the terminals, holding them in place within the interior of each of the chambers (3) of the connector (1).

As can be seen in FIG. 2 of the drawings, the locking element (5), which in the figure is shown in its working position, namely fully inserted in the track (4), forms part of the wall of the casing (2) of the electrical connector (1). In other words, the exterior face (10) of the locking element (5) is at approximately the same level as the exterior wall of the casing (2) and, therefore, the dimensions and the geometry of the unit remain unaltered after the insertion of the locking element (5).

Due to the universality of the geometry of the locking element (5) described, it can be used with different types of electrical connector with the consequent reduction in costs that this implies. The electrical connector (1) described offers great efficiency as regards the connection of the terminals thanks to the stability with which these are held within the interior of the chambers (3) that in turn make up the interior of the casing (2).

It must be highlighted that one of the great advantages of the above-described connector is that the lateral position of the locking element (5) within the casing (2) in no way interferes with the geometry of any of the chambers (3). That is to say that the interior configuration of the casing (2) of the connector (1) does not have to be modified in order for the locking element (5) to be mounted, contrary to that which occurs with the currently available connectors being used for the same purpose at present. Regarding the conventional connectors, the locking element is inserted in either the upper part or the lower part of the casing of the connector, which inevitably affects the internal configuration of the connector. This does not happen with a connector (1) when using the invention hereby presented, which signifies a notably more simple construction process.

On the other hand, the fact that the geometry of both the locking element (5) and the track (4) into which it slides only permits a single insertion position must be especially taken into account. The positioning devices used on conventional connectors can therefore be eliminated if so desired.

Figure 3:
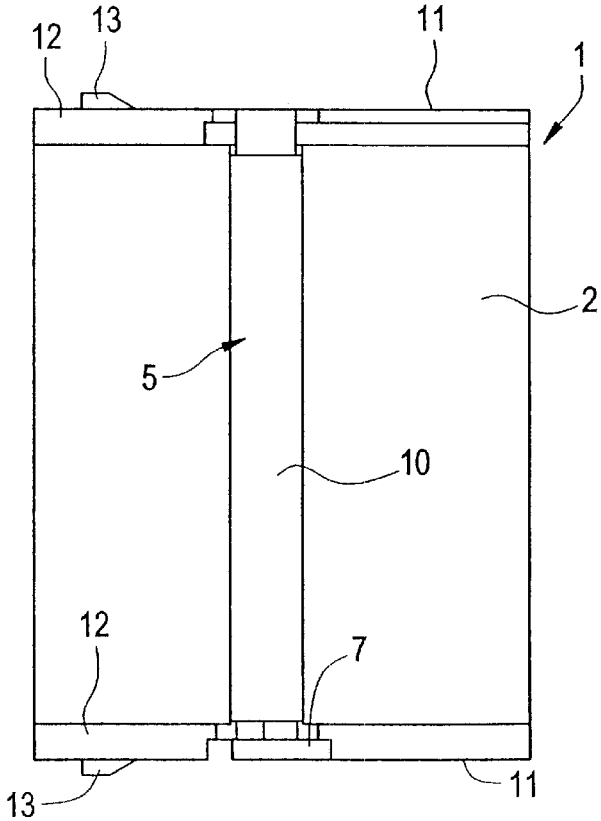
FIG. 3 shows an elevation of a connector unit in accordance with FIG. 2.

In reference to FIGS. 1 and 3, on the smaller lateral walls (11) there exist a number of parallel vanes (12), between which there is situated an elastic attachment (13) that becomes compressed when the connector (1) is introduced into the interior of a junction box (not shown).

Figure 4:
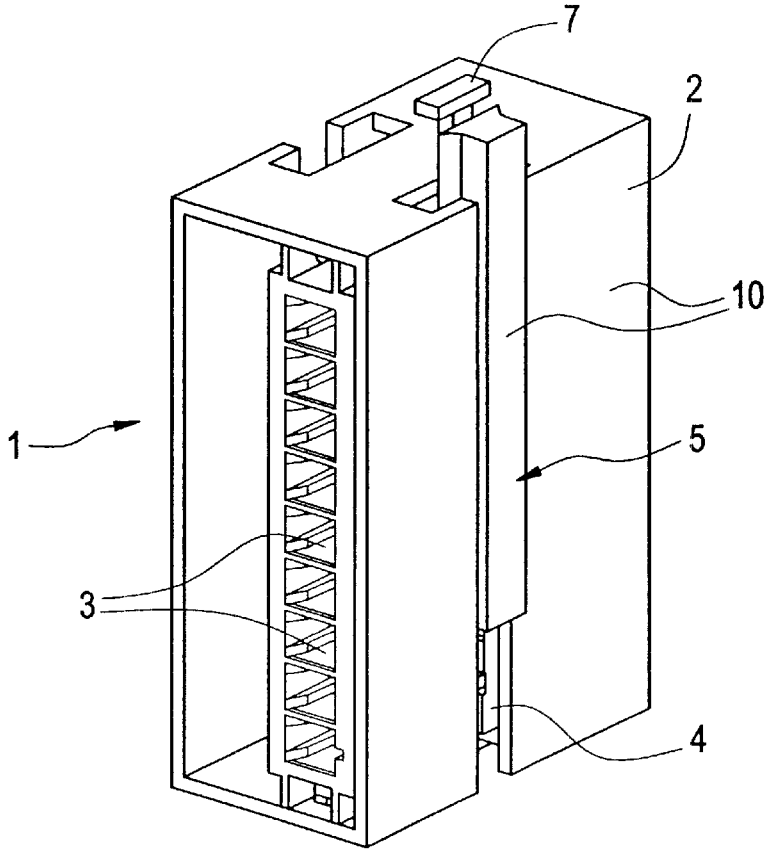
FIG. 4 is a view in perspective of an electrical connector of different configuration that includes the locking element of the invention, which is illustrated partially introduced into the connector.
Figure 5:
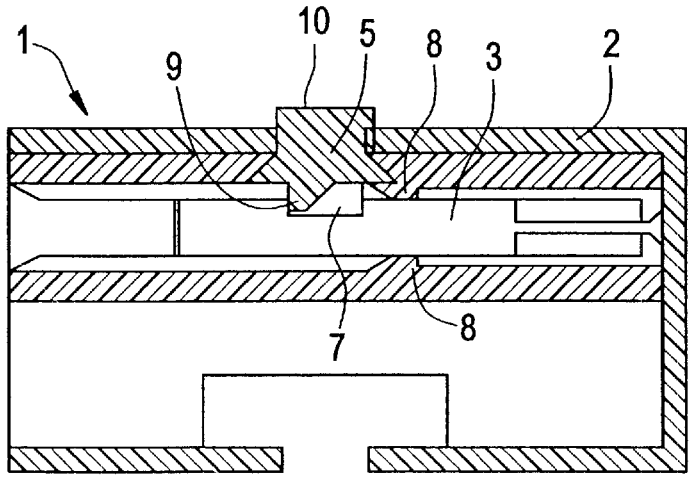
FIG. 5 is a view in transverse section of the connector unit shown in FIG. 4 together with the locking element of the invention.

In FIGS. 4 and 5 an electrical connector of a different configuration to those featured in FIGS. 1, 2 and 3 is shown. This connector (1) is equipped with a locking element (5) identical to that in FIGS. 1, 2 and 3. The same reference numbers are used to indicate the same elements that are featured in the aforementioned FIGS. 4 and 5.

Without straying from the essence of the present invention or from the inventive concept thereof as defined in the claims included below, all the materials of the elements that go to make up the connector unit of the present invention, as well as the shapes, the dimensions and the rest of the accessory elements, can be replaced by others as long as these are of technical equivalence.

What is claimed is:

1. An electrical connector unit with a locking element, said electrical connector unit (1) comprising: a casing or housing (2) adapted to accommodate a number of electrical terminals associated with corresponding cables, and a locking element (5) for said terminals, said locking element (5) being coupled to the connector (1) by a slide-mount along at least one lateral wall of the connector, said locking element including a longitudinal flange (9) that extends towards the interior of the connector (1) in order to hold the terminals in place in such a way that the locking element (5) fixes the terminals transversally with respect to a position of the terminal within the connector (1), wherein said locking element (5) comprises a dovetail shape fitting into a guide track (4) cut along the at least one lateral wall of the connector (1).

* * * * *